US006409102B1

(12) United States Patent
Luttrell et al.

(10) Patent No.: US 6,409,102 B1
(45) Date of Patent: Jun. 25, 2002

(54) FUEL INJECTOR ASSEMBLY

(75) Inventors: Jabe R. Luttrell, Burlington; Donald G. Fortier, Torrington, both of CT (US)

(73) Assignee: Aerosance, Inc., Farmington, CT (US)

( * ) Notice: Subject to any disclaimer, the term of this patent is extended or adjusted under 35 U.S.C. 154(b) by 0 days.

(21) Appl. No.: 09/268,601

(22) Filed: Mar. 15, 1999

(51) Int. Cl.[7] ..... F02M 51/00
(52) U.S. Cl. ..... 239/585.4; 239/585.1
(58) Field of Search ..... 239/585.1, 585.2, 239/585.3, 585.4, 585.5

(56) References Cited

U.S. PATENT DOCUMENTS

| | | | | | |
|---|---|---|---|---|---|
| 3,665,601 | A | * | 5/1972 | Dunbabin | 29/629 |
| 3,704,833 | A | * | 12/1972 | Wheat | 239/585.2 |
| 3,731,881 | A | * | 5/1973 | Dixon et al. | 239/585.1 |
| 4,314,863 | A | * | 2/1982 | McCormick | 148/37 |
| 4,643,359 | A | | 2/1987 | Casey | 239/585 |
| 5,014,671 | A | * | 5/1991 | Taue et al. | 239/585.1 |
| 5,190,221 | A | * | 3/1993 | Reiter | 239/585.1 |
| RE34,527 | E | * | 2/1994 | Yoshida et al. | 239/585.1 |
| 5,301,874 | A | * | 4/1994 | Vogt et al. | 239/585.1 |
| 5,340,032 | A | * | 8/1994 | Stegmaier et al. | 239/585.1 |
| 5,732,888 | A | * | 3/1998 | Maier et al. | 239/585.1 |
| 5,732,889 | A | * | 3/1998 | Sasao | 239/585.1 |
| 5,794,860 | A | * | 8/1998 | Neumann | 239/585.3 |
| 5,915,591 | A | | 6/1999 | Erickson et al. | 221/1 |
| 5,944,262 | A | * | 8/1999 | Akutagawa et al. | 239/585.4 |
| 5,996,910 | A | * | 12/1999 | Takeda et al. | 239/585.1 |
| 6,045,116 | A | * | 4/2000 | Wilke et al. | 239/585.1 |
| 6,071,355 | A | * | 6/2000 | Suratt | 134/21 |

FOREIGN PATENT DOCUMENTS

| | | |
|---|---|---|
| DE | 197 12 590 | * 10/1998 |
| WO | WO98/42976 | * 10/1998 |

* cited by examiner

*Primary Examiner*—Lesley D. Morris
*Assistant Examiner*—Christopher Kim
(74) *Attorney, Agent, or Firm*—Kirkpatrick & Lockhart LLP

(57) ABSTRACT

A valve that is well-suited for controlling the injection of fuel into an engine. The valve may include an inner housing that includes a movable valve stem and that is removably attachable to an engine. An electrically-actuatable coil assembly is removably attached to the inner housing of the valve for selectively moving the valve stem within the inner housing to permit fuel to pass through the valve into the engine upon an application of an electrical current to the electrically actuatable coil.

23 Claims, 7 Drawing Sheets

FUEL INJECTOR ASSEMBLY

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to valves. More particularly, the present invention is directed to electronically-actuatable valves adapted for controlling the injection of a fuel into an engine.

2. Description of the Background

Many conventional engines of all fuel types including gasoline and diesel typically employ a fuel injector for supplying known quantities of fuel to each combustion chamber at precise times during the engine cycle. Typically, a fuel injector assembly is mounted on the engine cylinder head of a combustion chamber. The fuel injector functions to open and close the fuel pump supply line to each engine cylinder head when commanded to do so by an electrical signal from the engine control computer.

One type of conventional fuel injector is a one-piece electromechanical assembly having a housing, a spring-loaded armature of magnetically permeable material and an electromagnetic coil adjacent the armature that is axially positioned within a fuel supply passage. The housing surrounds both the armature and coil. The electrical wires must pass through this housing without leakage and must be electrically isolated from the housing. When this fuel injector is unenergized, the valve is closed and the armature is held against a valve seat by spring and hydraulic forces to prevent fuel from entering the engine cylinder head. As an electrical current is passed through the electromagnetic coil, a magnetic field is created. When the force from the magnetic field becomes sufficient to overcome the hydraulic and spring forces, the armature will be urged away from the valve seat and fuel will pass through the engine cylinder head to the combustion chamber. When the electrical energy is no longer supplied to the electromagnetic coil, the magnetic force starts to decay and the spring and hydraulic forces then become dominant and move the armature against the valve seat to the closed position.

One disadvantage of this type of conventional fuel injector is that it is difficult to accommodate all of the components of the fuel injector within the limited amount of space available in a reciprocating, opposed cylinder aircraft engine. In many aircraft engine arrangements, for example, the minimum diameter of space for a fuel injector is less than 0.75 inches. Fuel injectors used in automotive applications occupy a space with a diameter of about 1.25 inches. Thus, sufficient room is not available within the aircraft engine envelope to accommodate the available automotive-type fuel injector components and also to provide for installation and removal of the fuel injector components from the engine cylinder head port.

Existing fuel injector assembly internal designs are also complicated by the need to connect electrical signals across internal fuel to air barriers, together with requiring the means to operate the internal electromagnetic components in a fuel wetted environment. The sealing arrangements needed to address this problem, besides impacting size and weight, also preclude separate replacement of electrical and fluid handling elements within the assembly. Therefore, the entire assembly must be discarded in the event of a single failure in either element. Such one-piece construction also prevents the desirable use of a threaded port for installation to the engine cylinder head or inlet manifold, because it would not be practical to rotate the complete assembly.

Yet another disadvantage with conventional fuel injectors is that the electromagnetic coil and electrical supply cable are located within the same unit as the fuel passageway. Thus, the electromagnetic coil and the electrical supply cable are susceptible to decay caused by fuel and fuel vapor. As such, coil wire insulation material has to be carefully selected so as to not break down in the presence of fuel or fuel vapors should internal seepage occur despite such sealing arrangements. Such requirements place restrictions on the overall assembly design which result in injector assemblies that are difficult to accommodate within the engine envelope due to their physical size. It also requires that the electrical coil and connection structure be an integral, non-removable part of the injector assembly housing. Such condition also necessitates injector installation to the engine as a complete assembly, not permitting the use of a threaded installation port.

Accordingly, there is a need for a fuel injector that is compact and that can be easily installed and removed from an engine.

The need also exists for a fuel injector that has an electromagnetic coil and an electrical supply cable that can be readily separated from the mechanical valve components of the fuel injector, such that the mechanical portion of the valve can be replaced without also replacing the valve's electrical component or the electrical components can be replaced without also replacing the mechanical portion of the valve.

Yet another need exists for a fuel injector assembly that can be readily attached to the cylinder head of an engine by a threaded port arrangement.

Still another need exists for injecting a fuel into the combustion chamber of an engine that does not require the use of prior bulky fuel injectors which lead to increased engine weight and engine size.

BRIEF SUMMARY OF THE INVENTION

The present invention provides a valve having an inner housing with an outlet port, a stopper member movably supported within the inner housing, a central housing member received within the inner housing and a magnetic flux that travels in a loop though the inner housing and the stopper member such that the magnetic flux urges the stopper member from a closed position, wherein the stopper member blocks the outlet port to an opened position.

The present invention further provides a valve having an inner housing of magnetically permeable material, a stopper member of magnetically permeable material, a central housing member of non-magnetically permeable material and an electrically-energizeable coil adjacent the inner housing, wherein the central housing member acts as a shunt such that the magnetic flux created by the coil bypasses the central housing member and travels through the stopper member.

The present invention further provides a fuel injector having an inner housing of magnetically permeable material with a valve passage and an outlet port, a valve stem movably received with the valve passage between a closed position, wherein the valve stem blocks the outlet port and an opened position, a biaser in contact with the valve stem, and an electrically-energizeable coil extending around at least a portion of the central housing member and adjacent the inner housing such that upon an application of current to the electrically energizeable coil, a magnetic flux is established within the magnetically permeable materials of the inner housing and the valve stem to cause the valve stem to move to the opened position. The inner housing of the fuel injector may be releasably connected to a cylinder head of an engine such as an aircraft engine.

The present invention further provides a two-part electromechanical valve having an electrical assembly and a fluid handling assembly, wherein these two separate assemblies provide a sealing arrangement that isolates the electrical components from the fluid that is passing through the valve. The electrical assembly includes a magnetically permeable cover with an opening for receiving an electrical supply cable, a bobbin inserted inside the cover, potting material contained within the cover and an electrically-energizeable coil wound around the bobbin and able to be electrically connected to the electrical supply cable. The fluid handling assembly includes a housing having a fluid passage that receives a stopper member and the fluid handling assembly is releasably connected to the electrical assembly using a connector.

The present invention further provides a method of injecting fuel into an engine comprising attaching an inner housing of a fuel injector to an engine, wherein the inner housing is made of magnetically permeable material with an outlet port and a passage, and the fuel injector further comprises a stopper member of magnetically permeable material and a central housing member of nonmagnetically permeable material, and wherein the stopper member is received within the inner housing, and the central housing member is received within the inner housing and adjacent the stopper member; transporting fuel into the passage; supplying fuel to the passage; and creating a magnetic flux through the inner housing and the stopper member such that the magnetic flux urges the stopper member from a closed position, wherein it blocks the outlet port, to an opened position.

Other details, objects and advantages of the present invention will become more apparent with the following description of the present invention.

BRIEF DESCRIPTION OF THE SEVERAL VIEWS OF THE DRAWINGS

For the present invention to be understood and readily practiced, the present invention will be described in conjunction with the following Figures wherein:

FIG. 5 is an enlarged cross-sectional view of the spherical union and connector of the fuel injector shown in FIG. 1*a.

DETAILED DESCRIPTION OF THE INVENTION

The present invention will be described below in terms of a fuel injector. It should be noted that describing the present invention in terms of a fuel injector is for illustrative purposes and the advantages of the present invention may be realized using other structures and technologies that have a need for a valve configuration, wherein the valve configuration is compact, provides for easy installation, removal and servicing as well as provides a high integrity mechanical separation of the electrical components from the fluid passing through the valve.

It is to be further understood that the Figures and descriptions of the present invention have been simplified to illustrate elements that are relevant for a clear understanding of the present invention, while eliminating, for purposes of clarity, other elements and/or descriptions thereof found in a typical fuel injector. Those of ordinary skill in the art will recognize that other elements may be desirable in order to implement the present invention. However, because such elements are well known in the art, and because they do not facilitate a better understanding of the present invention, a discussion of such elements is not provided herein.

Figure 1A:
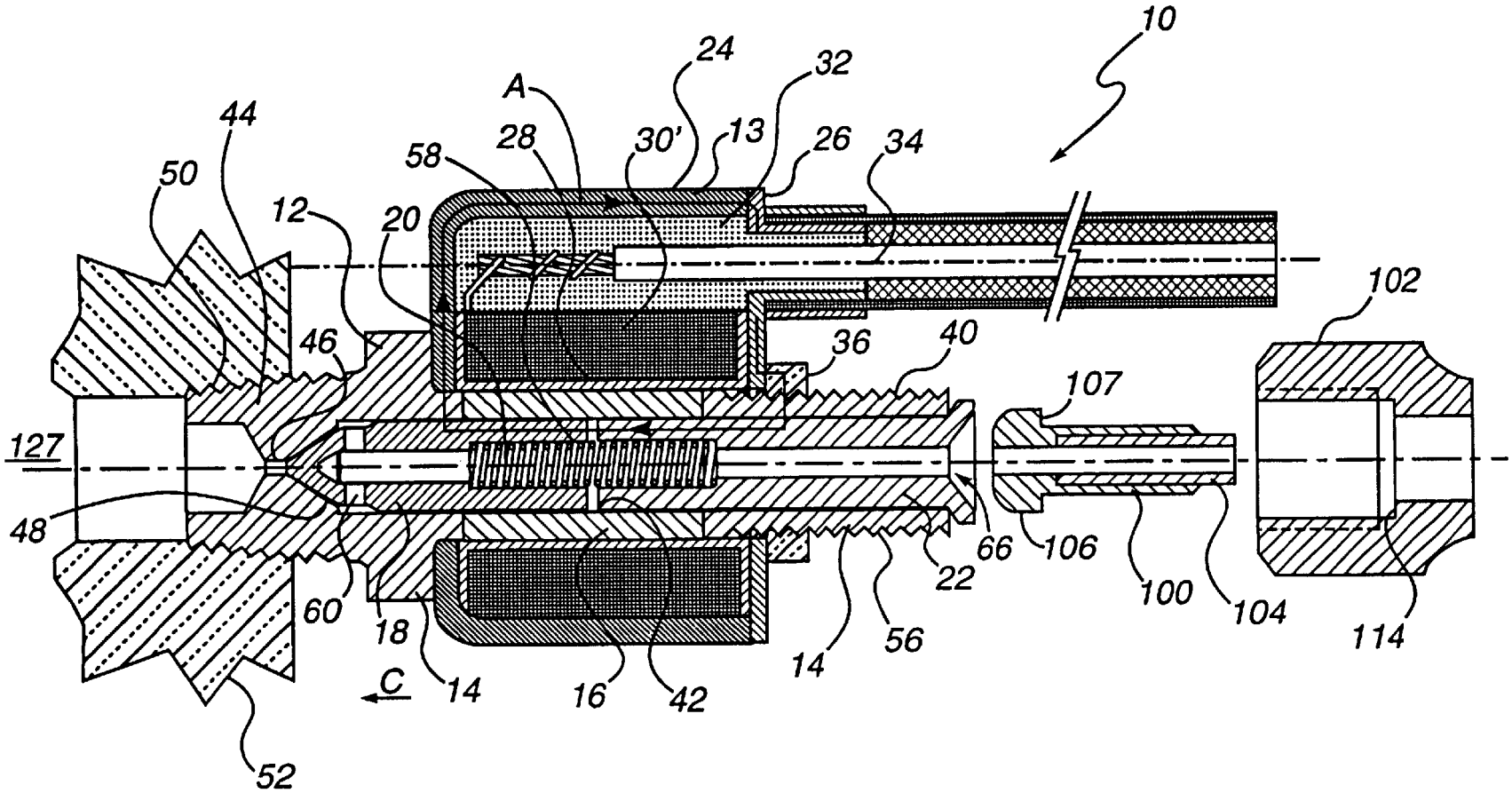
FIG. 1*a* is a cross-sectional view of a fuel injector of the present invention, wherein the valve stem is in the closed position.
Figure 1B:
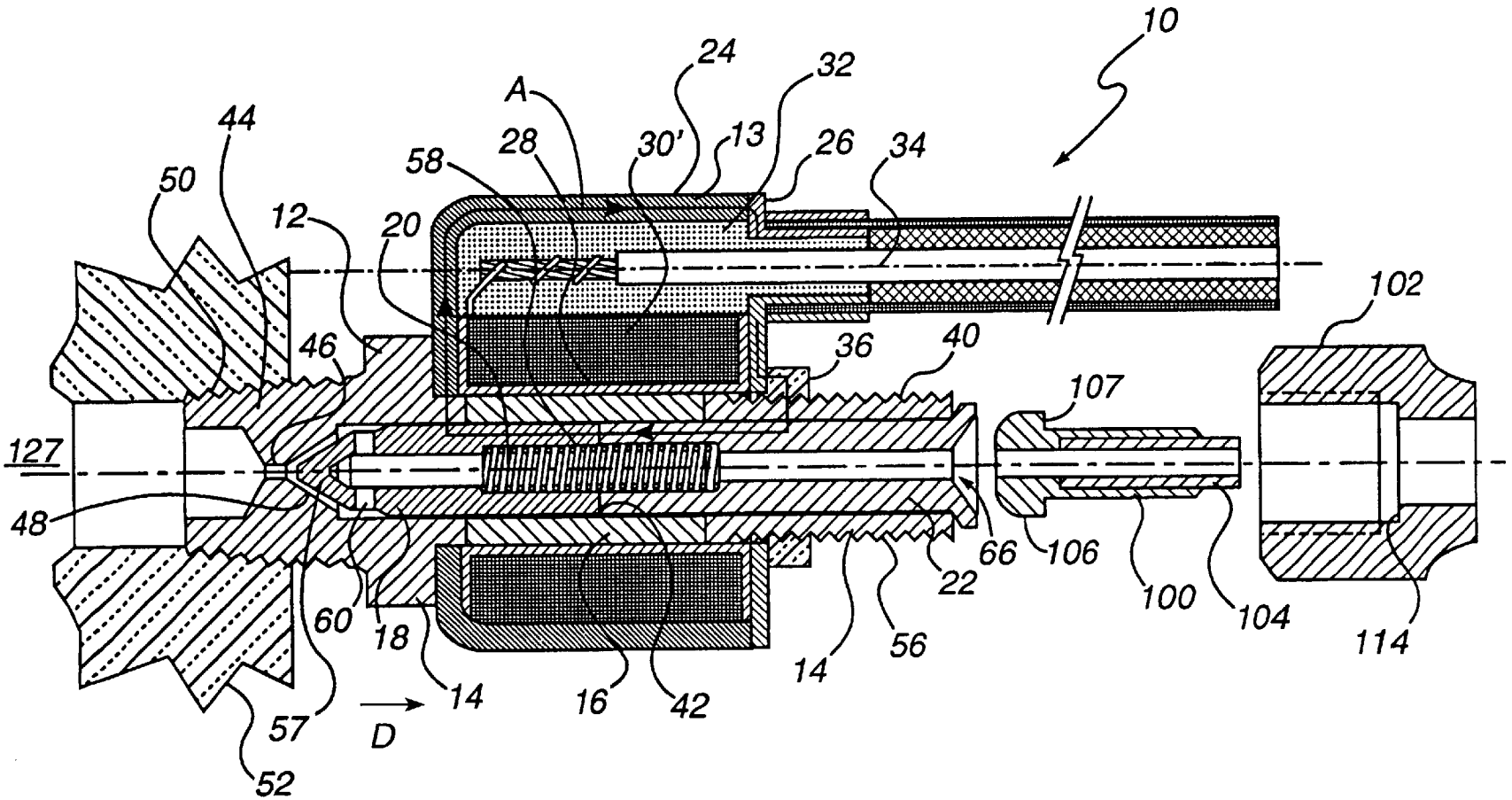
FIG. 1*b* is a cross-sectional view of the fuel injector shown in FIG. 1*a,* wherein the valve stem is in the opened position.

FIGS. 1*a* and 1*b* illustrate cross-sectional views of a fuel injector 10 which employs the present invention, wherein the valve stem 18 or stop member of the fuel injector 10 is shown in its closed position and open position, respectively. The fuel injector 10 substantially comprises a fluid handling assembly 12 and an electrical supply assembly 13. The fluid handling assembly 12 includes an inner housing 14 valve housing, a central housing member 16, a valve stem 18, a spring 20 and a fluid supply conduit supporter 22. The electrical supply assembly 13 includes a cover 24 with a cap member 26, a bobbin 28, an electromagnetic coil 30', potting material 32 and an electrical supply cable 34. The fluid handling assembly 12 is releasably connected to the electrical supply assembly 13 by a nut 36.

Figure 2:
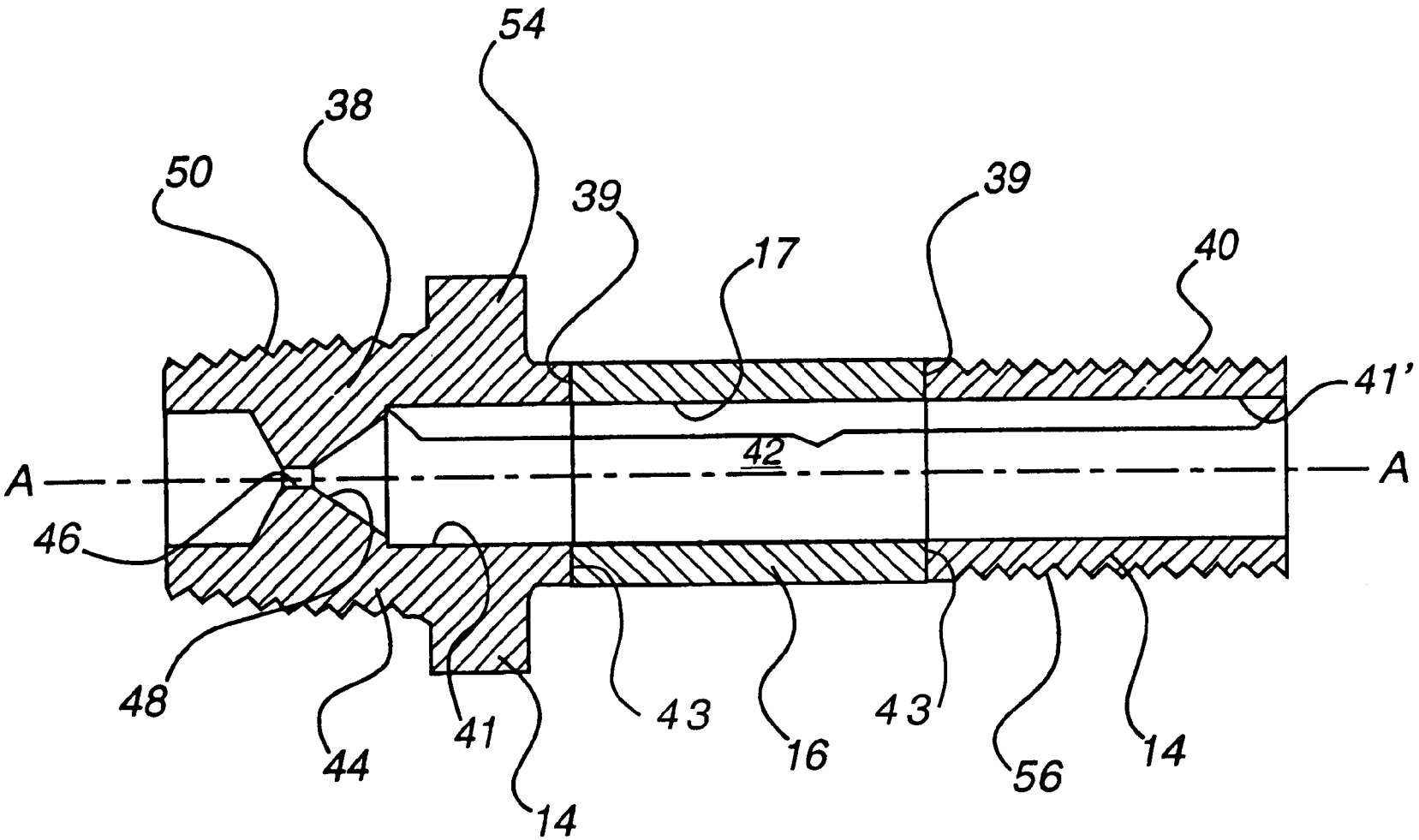
FIG. 2 is an enlarged cross-sectional view of the inner housing and the central housing member of the fuel injector shown in FIG. 1*a;*

FIG. 2 is an enlarged cross-sectional view of the inner housing 14 and the central housing member 16 of the fuel injector 10 of the present invention shown in FIG. 1*a*. The inner housing 14 has a first end portion 38 and a second end portion 40. The first end portion 38 has a first passage 41 therein and the second end portion 40 has a second passage 41' therein. The first end portion 38 has a nozzle portion 44 with an outlet port 46 and a seat portion 48 that communicates with the first passage 41 therein. The seat portion 48 is substantially conical shaped; however, alternative configurations can be used. The outer surface of the nozzle portion 44 has threads 50 which are adapted to engage a threaded cylinder head 52 of an engine, shown in FIGS. 1*a* and 1*b*. In addition, the first end portion 38 is provided with a hexagonal shoulder 54 to permit wrenching of the inner housing 14 into the engine cylinder head 52.

The outer surface of the second end portion 40 has threads 56 for threadably receiving the nut 36 thereon, as shown in FIGS. 1*a* and 1*b*. The inner housing 14 is made of stainless steel C40 alloy which is a magnetically permeable material. As used herein, the term "magnetically permeable material" means any material that the magnetic flux preferentially conducts within rather than the surrounding air. Specifically, Carpenter Technology high permeability 49 alloy can be used. Other magnetically permeable materials can be used to manufacture the inner housing 14 such as Carpenter Technology stainless steel 430F or other ferritic steels.

The central housing member 16 is a substantially tubular member having two end surfaces 39 and a passage 17 extending therethrough. The central housing member 16 is received between the first end portion 38 and the second end portion 40 of the inner housing 14 such that passage 17 is coaxially aligned on axis A—A with the first passage 41 and the second passage 41' to form a continuous passageway 42. See FIG. 2. The central housing member 16 is fixedly connected to the first and second end portions 38 and 40 at its end surfaces 39 by conventional inertial welds 43. The inertial welds 43 are produced by holding one of the two parts being joined stationary and rotating the other part with a machine spindle. Thus, utilizing this method, to attach the first end portion 38 to the central housing member 16, one end 39 of the central housing member 16 is abutted against a corresponding end of the first end portion 38 such that the passage 17 is coaxially aligned with the passage 41. Thereafter, a rotational force is applied to either the first end portion 38 or the central housing member 16 while retaining the adjacent member stationary. Those of ordinary skill in the art will appreciate that, as the rotating member abuts the stationary member heat is generated therebetween which results in the welding together of the member. That is, energy for the weld 43 is supplied by the kinetic energy stored in the rotating part. The central housing member 16 is manufactured from 304 stainless steel which is a readily and widely available and is a non-magnetically permeable material. As used herein, the term "non-magnetically permeable material" means material that magnetic flux has no preference for conducting within rather than air. Other non-magnetically permeable materials can be used for the central housing member 16 such as 303 stainless steel or 304L stainless steel or martensitic steels or non-ferrous materials.

Figure 3:
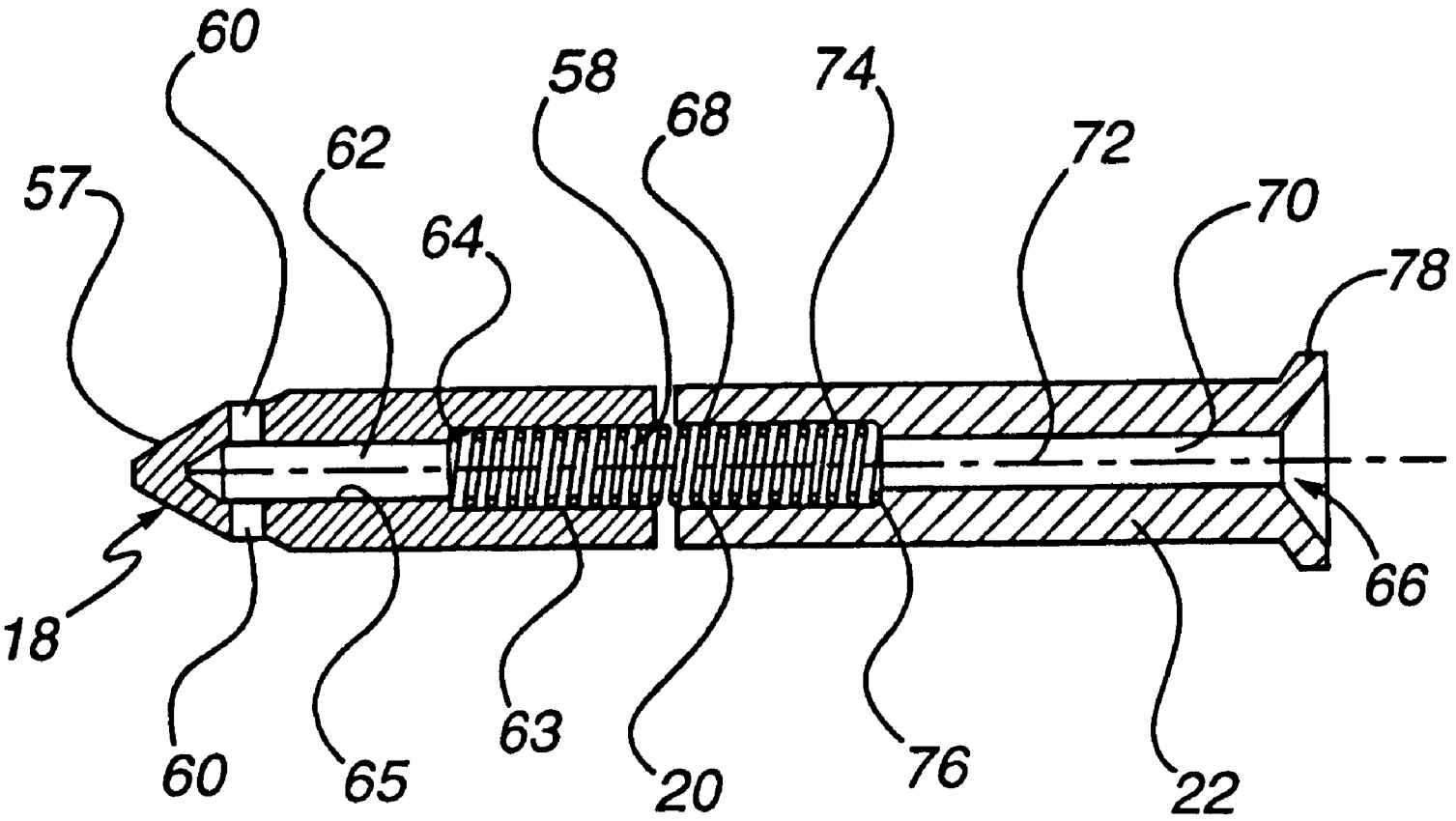
FIG. 3 is an enlarged cross-sectional view of the valve stem, the fluid conduit supporter structure and the spring of the fuel injector shown in FIG. 1*a;*

FIG. 3 is an enlarged cross-sectional view of the valve stem 18, the fluid supply conduit supporter 22 and the spring 20 of the fuel injector 10 of the present invention, as shown in FIG. 1*a*. The valve stem 18 is a substantially tubular member having a conical nose portion 57, an inlet port 58 and two outlet ports 60 which communicate with a duct 62 that extends generally along the centerline of the valve stem 18. The duct 62 has a large-diameter section 63, a small-diameter section 65 and a ledge 64 formed between the large-diameter and small-diameter sections 63 and 65. The ledge 64 is substantially perpendicular to the centerline of the duct 62. The spring 20 extends within the large-diameter section 63 of the duct 62 and contacts the ledge 64. The spring 20 is made from 303 stainless steel and exhibits approximately one pound (1 lb.) to one and one-quarter pounds (1.25 lbs.) force. It has been discovered that such spring biasing force serves to overcome external forces, such as engine vibration forces, to thereby prevent the inadvertent opening of the fuel injector 10. However, other suitable biasing forces may be employed. Although not illustrated, any number of biasers can be used in place of the spring 20 which meet the size constraints of the present invention. The valve stem 18 is movably received within the passage 42 of the inner housing 14 and central housing member 16, as shown in FIGS. 1*a* and 1*b*. The valve stem 18 is manufactured from Carpenter Technology high permeability 49 alloy, which is a magnetically permeable material. Other magnetically permeable materials can be used to manufacture the valve stem 18 such as ferritic steels.

The fluid supply conduit supporter 22 is substantially tubular-shaped and defines an inlet port 66 and an outlet port 68, wherein the shape of the inlet port 66 is frustro-conical. A duct 70 extends along the centerline of the fluid supply conduit supporter 22 and has a small-diameter section 72 and a large-diameter section 74. The duct 70 is in fluid communication with the inlet port 66 and the outlet port 68. A ledge 76 is formed at the junction of the small-diameter section 72 and the large-diameter section 74. When the fluid supply conduit supporter 22 is coaxially aligned with the valve stem 18, as shown in FIG. 3, and an end of the spring 20 is received within the large-diameter section 74 of the supporter 22, the spring 20 extends between and engages the valve stem ledge 64 and the supporter ledge 76. The end of the supporter 22 adjacent the inlet port 66 has a flange 78 formed thereon. As can be seen in FIGS. 1*a* and 1*b*, the supporter 22 is received within passage 42 and is fixedly connected relative to the inner housing 14 and the central member housing 16 such that the flange 78 abuts the second end portion 40 of the inner housing 14. The supporter 22 is formed of Carpenter Technology 49 alloy, which is a magnetically permeable material. However, the supporter 22 can be formed of a variety of magnetically permeable materials such as ferritic steels. The materials selected for the invention were chosen for their magnetic permeability and corrosion resistant properties. Many magnetically permeable materials are not corrosion resistant. Although not illustrated, the supporter 22 and the second end portion 40 of the inner housing 14 can be a unitary member.

Figure 4:
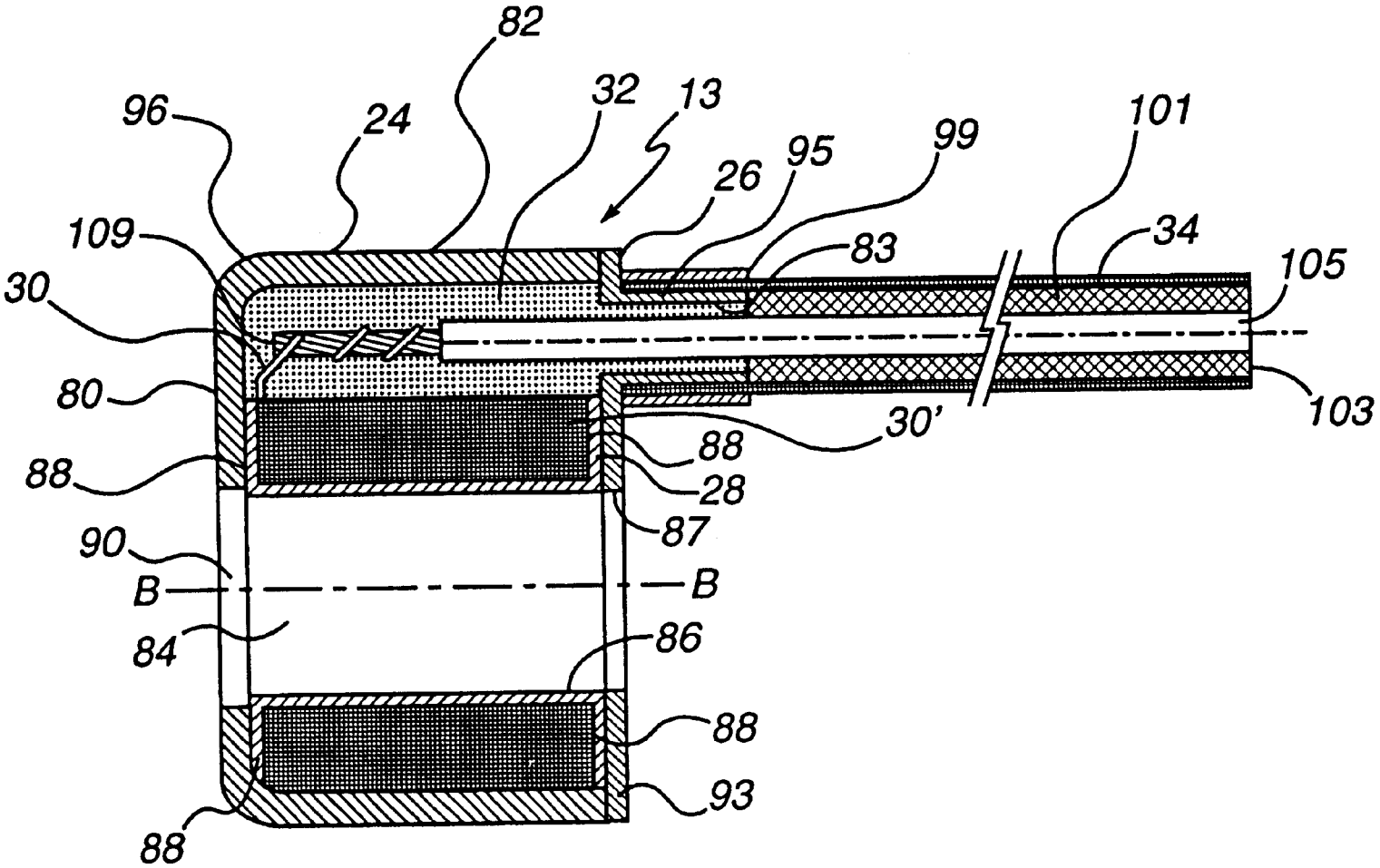
FIG. 4 is an enlarged cross-sectional view of the electrical supply assembly of the fuel injector shown in FIG. 1*a;*

FIG. 4 is an enlarged cross-sectional view of the electrical supply assembly 13 of the fuel injector 10 of the present invention, shown in FIG. 1*a*. The electrical supply assembly 13 includes a cover 24, a cap member 26, a bobbin 28, potting material 32, an electromagnetic coil 30' and an electrical supply cable 34. The bobbin 28, the cover 24 and the cap member 26 form an electrical housing, designated generally as 96. The cover 24 may be configured, as shown in FIG. 4, with a cup-shaped cross-section. In this embodiment, the cover 24 is fabricated from 430 stainless steel. However, other materials such as ferritic steels may be employed. As can be seen in FIG. 4, the cover 24 has a side portion 82 and a bottom portion 80 that has an aperture 90 extending therethrough. The cap member 26 includes a wall member 93 that is attached to the side portion 82 of the cover 24 by a weld and a cable-receiving portion 95. The cap member 26 is made from the same materials as the cover 24. An opening 87 is provided through the cap member 26. Cap member 26 may also receive the electrical supply cable 34.

As also can be seen in FIG. 4, the electrical supply assembly 13 includes a bobbin 28 that is fabricated from nylon or other plastic insulator materials. The bobbin 28 has a cylindrical center portion 86 and a flange 88 extending substantially perpendicularly from each end of the cylindrical center portion 86. The cylindrical center portion 86 defines a passage 84 that extends therethrough. In this embodiment, a conductor 30 such as high temperature insulated copper magnetic wire is wound around the cylindrical center portion 86 of the bobbin 28 between the flanges 88 thereof to form the electromagnetic coil 30'. The conductor 30 is a standard, maximum rated, high temperature wire that is capable of withstanding 200° F. continuously. Conductors, which meet NEMA STD MW-1000, MW-73-C/A, MW 35-C/A and Federal Spec. J-W-1177/14B(K), such as model GP/MR-200 manufactured by Essex Group, Inc.; model Armored Poly Thermaleze, APTZ manufactured by Phelps Dodge Magnetic Wire Co.; model Therm Amid, TAI manufactured by Rea Magnet Wire Co.; model Omega Klad II, OKII, manufactured by Westinghouse Electric Co.; and model Daitherm-3, DT-3 manufactured by Optec D.D.

USA, Inc. may be successfully employed. In one embodiment, wherein the outer diameter of the cylindrical center portion 86 is approximately 0.369 and the outer diameter of each of the flanges 88 is approximately 0.640 and the distance between the flanges 88 is approximately 0.560, a total of approximately 51.94 feet of the conductor 30 is wrapped around the cylindrical center portion 86. Those of ordinary skill in the art will appreciate that when a current of 3.54 amps is passed through the conductor 30, a magnetic flux of approximately 1368 ampere-turns is established by the electromagnetic coil 30'.

Referring further to FIG. 4, an electrical supply cable 34 is attached to the electromagnetic coil 30'. In this embodiment, the electrical supply cable 34 has a metal braided exterior layer 101, a shield 103, a metal conduit 105 and a conductor portion 109. The conductor portion 109 is made from stranded copper wire. The bobbin 28 and the coil 30' are installed in the cover 24, such that the passage 84 extending through the center portion 86 of the bobbin 28 is coaxially aligned with the opening 90 in the cover 24 along axis B—B. The insulating conduit 105 and the conductor 109 extends through the cable-receiving portion 95 in the wall portion 93 of the cap member 26, as shown in FIG. 4. The conductor 109 is soldered, welded, or otherwise electrically attached to the two leads of the coil 30' and a commercially available retainer ring 99 is used to affix the cable to the cap member 26 by placing the ring 99 around the cable-receiving portion 95 and crimping it in a known manner. The conductor 109 and the coil 30' are sealed, as shown in FIG. 4, in a potting material 32. The potting material 32 is a high dielectric, insulating potting material such as epoxy resin that eliminates arcing and sparking between the coil 30' and the conductor 109. For example, Thermoset 300 Resin and APC Lab Project WO82198-6 can be used.

The bobbin 28, the electromagnetic coil 30', the conductor 109 and potting material 32 are received within the cover 24, such that the passage 84 is coaxially aligned with opening 90 in the cover 24. Thereafter, the cap member 26 is affixed to the walls 82 of the cover 24 by laser welding or other method of controlled penetration. As noted above, the electrical supply cable 34 is connected to the electrical housing 96 by positioning the braided exterior layer 101 between the metal ring 99 and the tube portion 95 and crimping the metal ring 99 around the braided exterior layer 101. An alternate method of shield termination can also be employed by inserting the shield 103 into tube 83 and securing the shield 103 with a silver filled epoxy to achieve electrical conductivity. It will be appreciated that the potting material 32 fills the space remaining in the electrical housing 96 such that the potting material 32 surrounds the electromagnetic coil 30' and the electrical supply cable 34 within the electrical housing 96.

Figure 5:
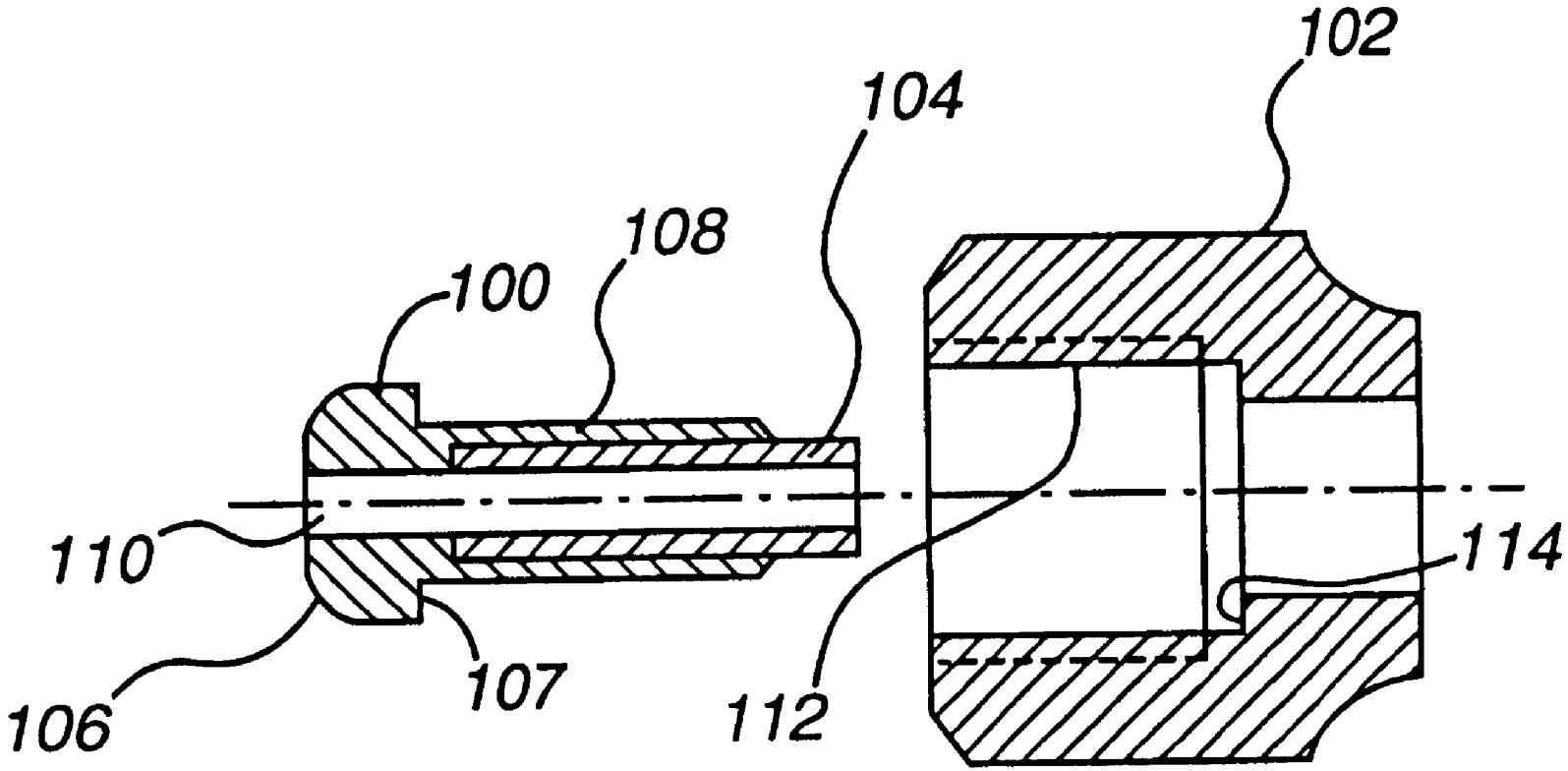

FIG. 5 is an enlarged cross-sectional view of the spherical union 100 and the connector 102 of the fuel injector 10 of the present invention, as shown in FIG. 1*a*. The spherical union 100 and the connector 102 join a fuel supply conduit 104 to the support inlet port 66 and also fixedly connect the supporter 22 to the inner s housing 14 and the central housing member 16, as shown in FIGS. 1*a* and 1*b*. The spherical union 100 has a spherical head portion 106, a shoulder 107, a tubular body 108 and a channel 110 which receives the fuel supply conduit 104. The fuel supply conduit 104 is fixedly connected to the spherical union 100 by brazing. The connector 102 is a hex nut with internal threads 112 which mate with the threads 56 of the inner housing 14, as shown in FIG. 1*a*. The head portion 106 is received within the supporter inlet port 66. The connector 102 is then slid over the tubular body 108 of the spherical union 100 and threaded onto threads 56 until the spherical union shoulder 107 engages the connector shoulder 114. The head portion 106 is spherical such that when the supporter inlet port 66 receives the spherical head portion 106 and the connector 102 fully engages the threads 56, a fluid tight connection is made between the fuel supply conduit 104 and the fluid supply conduit supporter 22. By threading the connector 102 onto the threads 56 of the inner housing 14, the flange 78 of the supporter 22 is fixedly held in place relative to the inner housing 14 between the inner housing 14 and the connector 102. Specifically, the flange 78 is wedged between the spherical union 100 and the inner housing 14. The fuel supply conduit 104, the connector 102 and the spherical union 100 are metal. In general, metals are used for most of the components of the fuel injector 10 to minimize static that may cause electronic instrumentation to malfunction.

Figure 6:
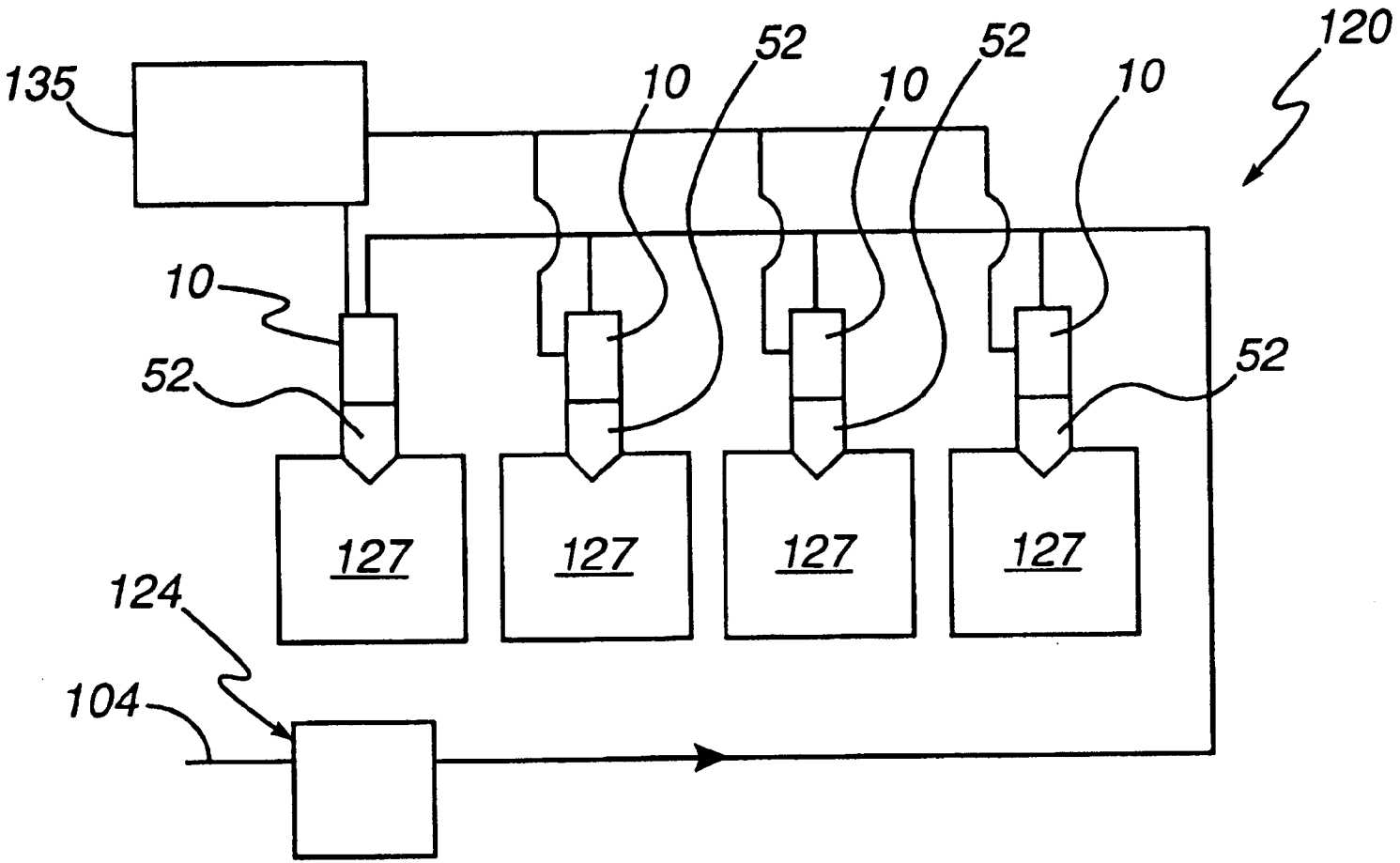
* and FIG. 6 is a schematic of an internal combustion engine assembly employing the fuel injector of the present invention.

FIG. 6 is a schematic view of an internal combustion engine system 120 employing the fuel injector 10 of the present invention. The internal combustion engine system 120 depicted in that Figure includes a fuel supply conduit 104, a pump 124 and a plurality of individual cylinder heads 52 connected to combustion chambers 127. A fuel injector 10 is connected to and between each of the plurality of engine cylinder heads 52 and the fuel supply conduit 104.

Referring to FIGS. 1*a*, 1*b* and 6, the fuel injector 10 is assembled in the following manner. The threaded nozzle portion 44 is threaded onto mating threads in the engine cylinder head 52. The electrical supply assembly 13 is slid over the fluid handing assembly 12 such that the inner housing 14 and central housing member 16 extend through the cover aperture 90, the bobbin passage 84 and the cap member opening 87. The electrical supply assembly 13 is releasably retained on the fluid handling assembly 12 by nut 36. The nut 36 is threaded onto the threads 56 of the inner housing first end portion 40 until the nut 36 contacts the cap member 26.

The fuel supply conduit 104 is attached to the fluid handling assembly 12 by inserting the head portion 106 into the supporter inlet port 66. The connector 102 is then slid over the tubular body 108 of the spherical union 100 and threaded onto threads 56 until the spherical union shoulder 107 engages the connector shoulder 114. Because the fuel injector 10 of the present invention can be installed onto the engine cylinder head 52 by rotating the fluid handling assembly 12 into the engine cylinder head 52 and subsequently installing the electrical supply assembly 13 onto the fluid handling assembly 12 without rotation of the fuel injector 10, the present invention is especially well suited for use in engine applications wherein fuel injector space is limited.

In operation, the fuel is pumped through the fuel supply conduit 104 to the fuel injector 10 where the fuel is injected in a measured amount and at desired times through the engine cylinder heads 52 to the combustion chamber 127. When the fuel injector 10 is in the closed position, as shown in FIG. 1*a*, the conical nose portion 57 is received within the seat portion 48, fuel is prevented from passing through the outlet port 46 into the combustion chamber 127. Those of ordinary skill in the art will appreciate that, when the coil 30' of the fuel injector 10 is unenergized, the spring 20 and the fluid pressure of the fuel within the valve stem 18 biases the valve stem 18 in the direction represented by arrow "C" such that a substantially fluid-tight seal is established between the nose portion 57 of the valve stem 18 and the seat portion 48.

When the valve stem 18 is in its opened position, as shown in FIG. 1*b,* the fuel can flow out of the outlet ports 60 of the valve stem 18 and through the outlet port 46 of the inner housing 14 into the combustion chamber 127.

To open the fuel injector 10, an electrical current is supplied to the electromagnetic coil 30' to create a magnetic flux A, shown in FIGS. 1*a* and 1*b*. The electrical current is regulated by a controller 135, shown in FIG. 6, wherein the controller 135 can be the controller described in U.S. patent application Ser. Nos. 09/268,181 and 09/268,173, entitled Automatic Aircraft Engine Fuel Mixture Optimization and System and Method for Ignition Spark Energy Optimization, respectively, and being filed concurrently with this application, the entire disclosures of which are heareby incorporated by reference herein. The magnetic flux A travels through the cover 24, the cap member 26, the nut 36, along the supporter 22 and the valve stem 18, through the first end portion 38 of the inner housing 14 and back to the cover 24 to create a closed loop, as shown in FIGS. 1*a* and 1*b*. The cover 24, the cap member 26, the nut 36, the supporter 22, the valve stem 18 and the inner housing 14 are all made of magnetically permeable material to support the establishment of the flux therein. However, the magnetic flux A does not travel through the central housing member 16 because it consists of non-magnetically permeable material. Thus, the central housing member 16 acts as a magnetic break to force the flux to pass through the supporter 22 and valve stem 18. When the forces created by the magnetic flux A become sufficient to overcome the hydraulic and spring forces in the "C" direction, the magnetic flux force will urge the valve stem 18 towards the supporter 22 (i.e., in the "D" direction, as shown in FIG. 1*b*. ) in order to permit fuel to flow through the outlet port 46 and into the combustion chamber 127. Once the electrical current is no longer supplied to the electromagnetic coil 30', the magnetic flux force starts to decay and the spring and hydraulic forces become the dominant forces and move the valve stem 18 in the "C" direction into sealing contact with the seat portion 48.

The flux path defined by the inner housing 14, the valve stem 18, the supporter 22, the cover 24, the nut 36, and the cap member 26, exhibits enhanced efficiency which enables the necessary magnetic flux force to be achieved using a small overall fuel injector 10 with an outer diameter of, for example, approximately 0.75 inches. Therefore, the fuel injector 10 of the present invention can be used in an engine design having space limitations, such as aircraft engines. In addition, because the electrical supply assembly 13 can be quickly detached from the fluid handling assembly 12, the fluid handing assembly 12 can be conveniently attached to the engine cylinder head 52 by a threaded connection. That is, the fluid handling assembly 12 can be screwed into the cylinder head 52 before the fuel supply conduit 104 and the electrical supply assembly 13 are attached. After the fluid handling assembly 12 is connected securely and without leakage to the engine cylinder head 52, the electrical supply assembly 13 and the fluid supply conduit 104 can be attached thereto in the above-described manners. Thus, this arrangement permits the fuel injector 10 to be quickly attached and detached from engine cylinder head 52. In addition, should the fluid handling assembly 12 needs to be replaced, it can be quickly replaced without requiring replacement of the electrical supply assembly 13. Similarly, should the electrical supply assembly 13 need to be replaced, it can be quickly replaced without replacing the fluid handling assembly 12.

Those of ordinary skill in the art will recognize, however, that many modifications and variations of the present invention may be implemented without departing from the spirit and scope of the present invention. The foregoing description and the following claims are intended to cover such modifications and variations.

What we claim is:

1. A valve, comprising:

an inner housing of magnetically permeable material, said inner housing having an outlet port therein;

a stopper member of magnetically permeable material movably supported within said inner housing, said stopper member is an elongated, tubular member having a tapered head portion and a constant and continuous cross-section for the remaining length thereof;

a central housing member of non-magnetically permeable material received within said inner housing and adjacent at least a portion of said stopper member, wherein said inner housing and said central housing member define a passage in which said stopper member is received, said passage has a shape that substantially corresponds to said tapered head portion and constant and continuous cross-section of the remaining length thereof of said stopper member such that said stopper member is movably received within and substantially fills said passage; and an electrically-energizeable coil adjacent said inner housing.

2. The valve of claim 1, wherein said stopper member is a one-piece structure.

3. The valve of claim 1, wherein said inner housing has a first end portion and a second end portion, and wherein said central housing member is between and connected to said first end portion and said second end portion of said inner housing.

4. The valve of claim 1, further comprising a supply conduit supporter received within said inner housing.

5. The valve of claim 4, further comprising a biaser positioned between said stopper member and said supply conduit supporter, wherein the biaser urges said stopper member to substantially block said outlet port.

6. The valve of claim 1, wherein said inner housing has a seat portion, and wherein said head portion of said stopper is sized and proportioned to sealingly contact said seat portion to form a fluid-tight connection therebetween.

7. The valve of claim 4, wherein said supply conduit supporter has an inlet port and a duct in communication with said inlet port, and wherein said stopper member has a stopper duct in fluid communication with said supply conduit supporter duct.

8. The valve of claim 1, wherein said electrically-energizeable coil is supported within an electrical housing that is removably attached to said inner housing.

9. A fuel injector, comprising:

an inner housing of magnetically permeable material, said inner housing having a valve passage therethrough and an outlet port communicating with said valve passage, wherein said valve passage has a tapered end portion and a constant and continuous cross-section for the remaining length thereof;

a stopper member of magnetically permeable material and movably received within said valve passage between a closed position, wherein said stopper member blocks said outlet port and an opened position, and wherein said stopper member has a cross-section that corresponds to the cross-section of said valve passage such that said stopper member fills said valve passage;

a biaser in said valve passage that urges said stopper member into said closed position;

a central housing member of non-magnetically permeable material received within said inner housing and defining a portion of said valve passage, wherein said inner housing and said central housing member are joined together by a weld; and an electrically-energizeable coil extending around at least a portion of said central housing member and adjacent said inner housing such that upon an application of current to said electrically-energizeable coil, a magnetic flux is established within said magnetically permeable materials of said inner housing and said stopper member to cause said stopper member to move to said opened position.

10. The fuel injector of claim 9, wherein said inner housing is stainless steel C40 alloy.

11. The fuel injector of claim 9, wherein said central housing member is stainless steel 304 alloy.

12. The fuel injector of claim 9, wherein said stopper member is stainless steel C40 alloy.

13. The fuel injector of claim 9, wherein said inner housing has a second portion that has an inlet port therein and wherein said second portion is releasably connected to a source of fuel.

14. The fuel injector of claim 9, wherein said electrically-energizeable, coil is supported within a separable electrical housing that is releasably connected to said inner housing.

15. The fuel injector of claim 9, wherein said electrically-energizeable coil comprises:

a bobbin member; and a conductor wound around said bobbin member.

16. The fuel injector of claim 15, wherein said bobbin member is received within a housing that is releasably attached to said inner housing.

17. The fuel injector of claim 15, wherein said bobbin member has a passage therethrough for receiving said inner housing and said central housing member therein.

18. The fuel injector of claim 15, wherein said electrically-energizeable coil is releasably attached to said inner housing by a threaded nut.

19. The fuel injector of claim 9, wherein said inner housing is threadably attachable to a cylinder head of an engine.

20. A fuel injector, comprising:

an inner housing of magnetically permeable material, said inner housing having a valve passage therethrough and an outlet port communicating with said valve passage, and wherein the valve passage a tapered end portion and a constant and continuous cross-section for the remaining length thereof;

a valve stem of magnetically permeable material movably received within said valve passage, the valve stem having a cross-section conforming in shape to said valve passage, the valve stem being selectively movable between a closed position, wherein said valve stem blocks said outlet port and an opened position;

a fluid supply conduit supporter received within said valve passage opposite said valve stem and releasably connectable with a fluid supply line, said fluid supply conduit supporter has a tubular portion with a constant cross-section and defines an inlet port and an outlet port, wherein the shape of the inlet port is frusto-conical, said fluid supply conduit supporter has a flange adjacent said inlet port, wherein said flange abuts against and extends outside of said inner housing;

a biaser extending between said fluid supply conduit supporter and said valve stem; and an electrically-energizeable coil extending around at least a portion of said valve stem and adjacent said inner housing such that upon an application of current to said electrically-energizeable coil, a magnetic flux is established within said magnetically permeable materials of said inner housing and said valve stem to urge said valve stem to said opened position.

21. The fuel injector of claim 20, further comprising a central housing member of non-magnetically permeable material and received in said inner housing, said inner housing has a first end portion and a second end portion, wherein said first end portion and said second end portion are connected to said central housing member by a weld.

22. The fuel injector of claim 20, wherein said electrically-energizeable coil is received within a cover assembly removably affixed to said inner housing.

23. The fuel injector of claim 22, wherein said electrically-energizeable coil comprised:

a bobbin member;

a conductor wound around the bobbin; and potting material contained within said cover.

* * * * *